US006562194B1

(12) United States Patent
Archer et al.

(10) Patent No.: US 6,562,194 B1
(45) Date of Patent: May 13, 2003

(54) METHOD OF CREPING PAPER WEBS

(75) Inventors: Sammy L. Archer, Lynnwood, WA (US); Robert E. Dristas, Canonsburg; Ross T. Gray, Moon Township, both of PA (US)

(73) Assignee: Calgon Corporation, Naperville, IL (US)

( * ) Notice: Subject to any disclaimer, the term of this patent is extended or adjusted under 35 U.S.C. 154(b) by 0 days.

(21) Appl. No.: 09/538,839

(22) Filed: Mar. 30, 2000

(51) Int. Cl.[7] ..... B31F 1/12

(52) U.S. Cl. ..... 162/111; 162/112; 162/113; 264/283

(58) Field of Search ..... 162/111–112, 168.1–168.2, 162/169, 164.6, 173, 179, 183–184, 158, 5.9, DIG. 4; 525/7, 10, 56, 331.7; 264/282–283; 156/183; 510/174; 524/503, 501, 500

(56) References Cited

U.S. PATENT DOCUMENTS 4,440,898 A * 4/1984 Pomplun et al. ..... 524/503
4,528,316 A 7/1985 Soerens
4,940,513 A 7/1990 Spendel
4,994,146 A * 2/1991 Soerens ..... 162/112
5,187,219 A 2/1993 Furman, Jr.
5,246,544 A 9/1993 Hollenberg et al.
5,338,807 A 8/1994 Espy et al.
5,382,323 A 1/1995 Furman et al.
5,460,695 A * 10/1995 Kato ..... 162/5
5,490,903 A * 2/1996 Chen et al. ..... 162/111
5,660,683 A * 8/1997 Sutman ..... 162/5
5,660,687 A * 8/1997 Allen et al. ..... 162/111
5,880,077 A * 3/1999 Ishibashi et al. ..... 510/174
5,944,954 A 8/1999 Vinson et al.

FOREIGN PATENT DOCUMENTS

CA 979579 12/1975

* cited by examiner

*Primary Examiner*—Jose Fortuna
(74) *Attorney, Agent, or Firm*—Michael B. Martin; Thomas M. Breininger

(57) ABSTRACT

A non-oil-based release aid used in a creping process for releasing a paper web from a Yankee dryer in the manufacture of a paper product having a formula for its block version as follows:

$$R—(OC_3H_6)_y(OC_2H_4)_zOH;$$

where R is a $C_8$ to $C_{20}$ alkyl or alkylaryl group, y plus z is greater than 20, and y is greater than z. The y moles of propylene oxide ($OC_3H_6$) and the z moles of ethylene oxide ($OC_2H_4$) may be added in random or block fashion. Examples of the chemical compound for the release aid are alkoxylated alkylphenols, alkoxylated fatty acids, and alkoxylated alcohols. A preferred chemical compound is an alkoxylated tall oil fatty acid. The release aid may optionally comprise from about 0% to about 20% by weight of an emulsifying surfactant. The release aid may comprise 70% to 100% by weight of the chemical compound, 0% to 20% by weight of emulsifying surfactants, and 0% to 10% by weight water. The release aid provides lubrication between the doctor blade and the Yankee dryer; allows the release of the paper web from the Yankee dryer, and improves the absorbency of the paper product.

9 Claims, 3 Drawing Sheets

Figure 1. Peel force versus the amount of release aid added to crepECCel 690HA.
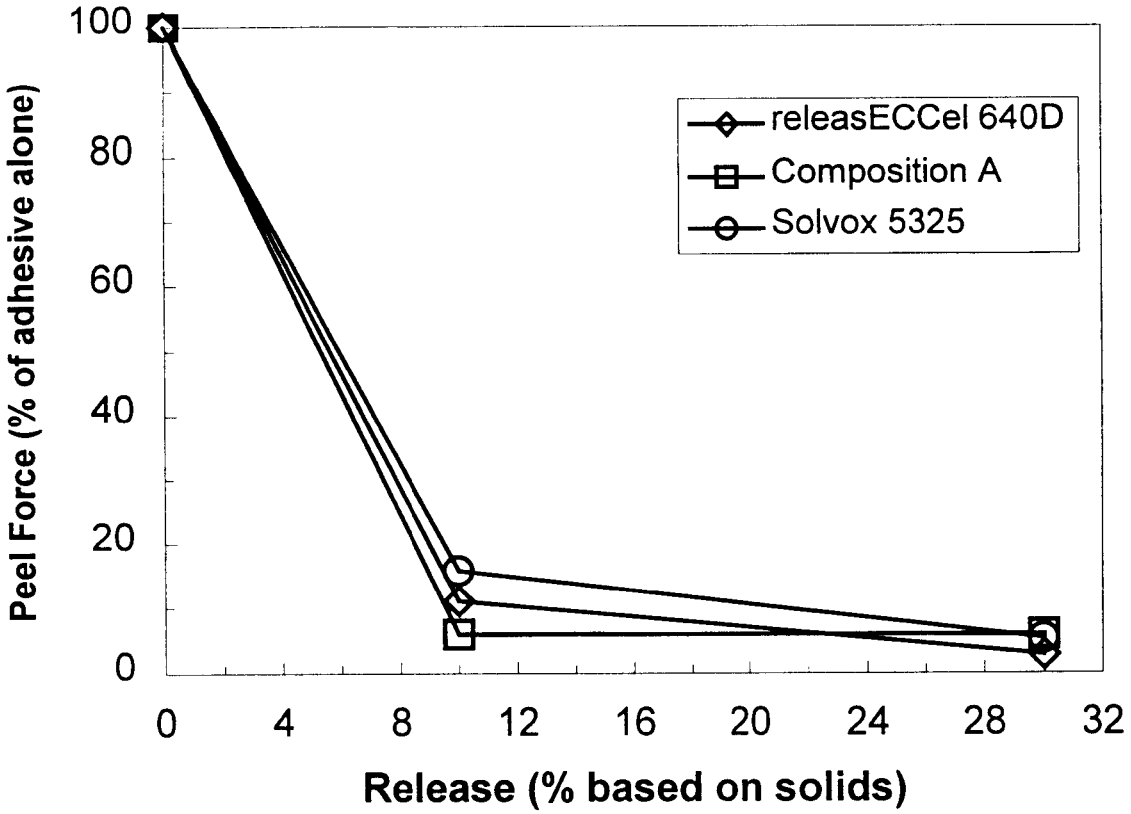

Figure 2. Uncured or initial absorbency time versus chemical dose.
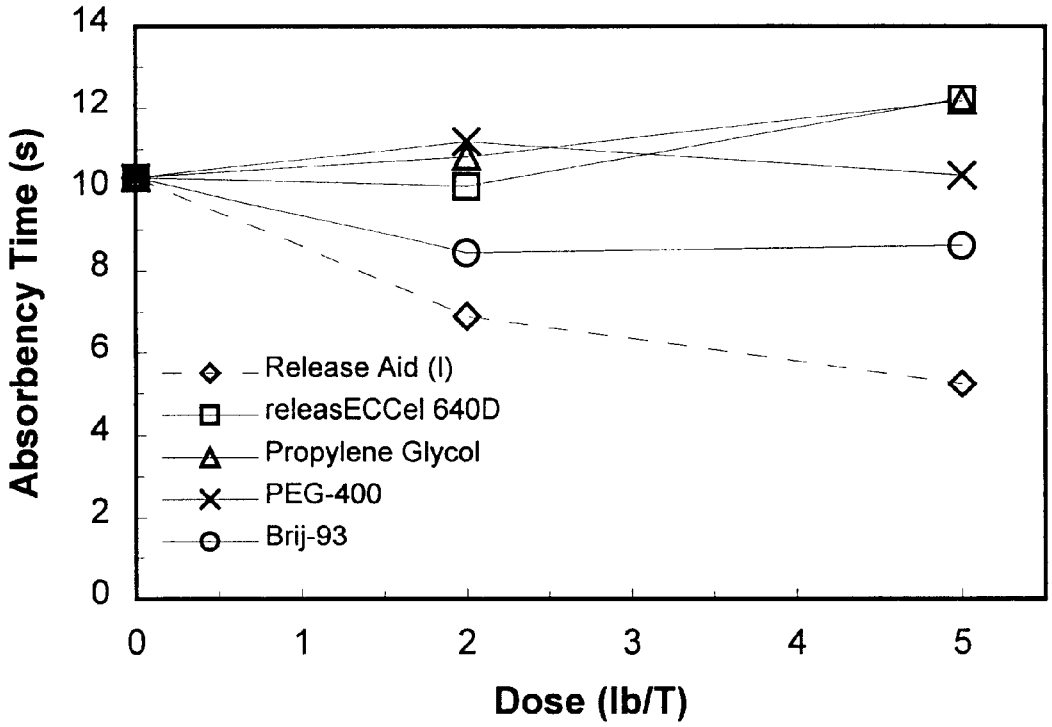

Figure 3. Cured or aged absorbency time versus chemical dose.
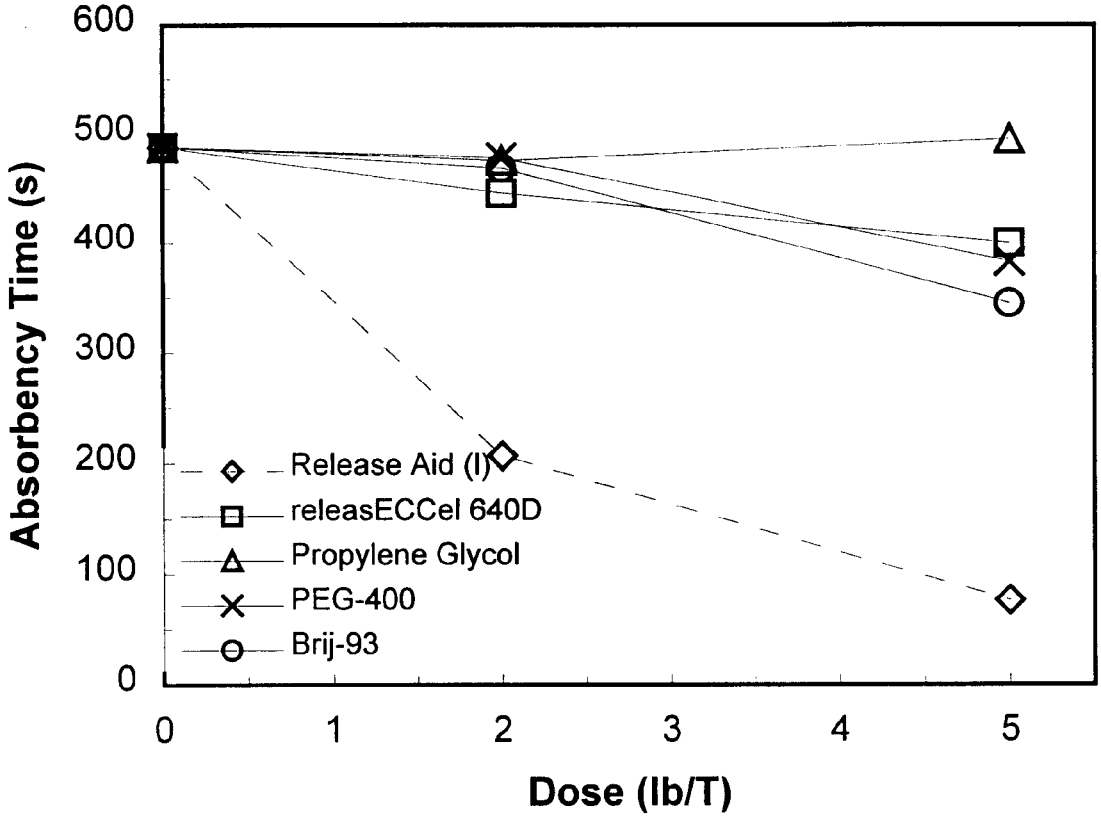

METHOD OF CREPING PAPER WEBS

FIELD OF THE INVENTION

The invention relates generally to a non-oil-based creping release aid used in the manufacture of tissue and/or towel products. The release aid can be used in conjunction with a creping adhesive aid during the creping process.

BACKGROUND OF THE INVENTION

In the manufacture of certain wet-laid paper products, such as facial tissue, bathroom tissue, or paper towels, the web is conventionally subjected to a creping process in order to give the web desirable textural characteristics, such as softness, bulk, stretch, and absorbency. The creping process involves the adherence of the web to a rotating creping cylinder, such as an apparatus known as a Yankee dryer, and then dislodging the adhered web from the cylinder with a doctor blade. The impact of the doctor blade against the web ruptures some of the fiber-to-fiber bonds within the web thereby causing the web to wrinkle or pucker.

The severity of this creping action is dependent upon a number of factors, including the degree of adhesion between the web and the surface of the creping cylinder. Greater adhesion causes increased softness, although generally with some loss of strength. In order to increase adhesion, a creping adhesive aid is used to enhance any naturally occurring adhesion that the web may have due to its water content, which will vary widely depending on the extent to which the web has been previously dried. Creping aids should also prevent wear of the dryer surface and provide lubrication between the doctor blade and the dryer surface and reduce chemical corrosion, as well as control the extent of creping. A coating that adheres the sheet just tightly enough to the drum will give a good crepe, imparting absorbency and softness with the least possible loss of paper strength. If adhesion to the dryer drum is too strong, the sheet may pick or even "plug", i.e. slip under the doctor blade, and wrap around the dryer drum. If there is not enough adhesion, the sheet will lift off too easily and undergo too little creping.

The creping adhesive, generally in an aqueous solution or dispersion form, is usually sprayed onto the surface of the creping cylinder, e.g. the Yankee dryer. If the pulp furnish sticks too strongly to the creping cylinder, a release aid is sprayed onto the cylinder. Release aids are typically hydrocarbon oils. These aids assist in the uniform release of the tissue web at the creping blade, and also lubricate and protect the blade from excessive wear. However, the hydrocarbon oil based release aid generally can have a negative effect on the absorbency of the final paper product.

A wide variety of creping adhesives are known to the paper industry. Examples of some adhesives of creping compositions are polyvinyl alcohol, ethylene/vinyl acetate copolymer, animal glue, polyamidoamine-epichlorohydrin resins (PAE resins) and polyvinyl acetate.

U.S. Pat. No. 4,528,316 discloses a creping adhesive aid comprising an aqueous admixture of polyvinyl alcohol and a water-soluble, thermosetting, cationic polyamide resin which provides increased adhesion in the manufacture of creped wadding.

U.S. Pat. No. 5,338,807 discloses a creping adhesive aid comprising the reaction product of a polyamide of a dibasic acid or of the ester of an aliphatic dibasic acid and methyl bis(3-aminopropylamine) with epichlorohydrin in a mole ratio of the polyamide to the epichlorohydrin between about 1:0.1 and about 1:0.33.

U.S. Pat. No. 5,382,323 discloses an improved halogen-free adhesive obtained by reacting adipic acid with diethylenetriamine at equimolar ratios of from 1.2:1.0 to 1.0:1.2 and then crosslinking with a dialdehyde selected from gluteraldehyde, glyoxal, or mixtures thereof. Improved adhesion and full strength are obtained.

U.S. Pat. No. 5,944,954 discloses a creping adhesive comprising cationic starch and optionally a polyvinyl alcohol and a water-soluble thermosetting cationic polyamide-epihalohydrin resin which provides high adhesion and doctorability for dry creping.

Other examples of creping adhesive compositions are disclosed in U.S. Pat. Nos. 5,187,219; 5,246,544; and 5,338,807; and in Canadian Patent No. 979,579. The latter two patents disclose the use of polyamidoamine/epichlorohydrin creping adhesives in conjunction with the aforesaid hydrocarbon oils as a release aid.

As is known to those skilled in the art, both a creping adhesive aid and a creping release aid can be used in the creping process either together in an aqueous solution or separately as aqueous solutions.

Release aids, such as hydrocarbon oils, are petroleum-based. These petroleum-based oils may or may not be used with an emulsifier that maintains the petroleum-based oils in suspension in an aqueous solution for spraying onto the cylinder of the Yankee dryer. As stated herein above, the oil in the final tissue and/or towel paper product can have a negative effect on the absorbency of the final paper product. Due to the hydrophobic nature of the petroleum-based oils, the oil in the final tissue and/or towel paper product can cause a reduction in its absorbency level, i.e. the ability of the final paper product to absorb water or water based solutions.

U.S. Pat. No. 5,660,687 issued to A. J. Allen, et al. discloses a creping release aid for particular use with polyamidoamine/epichlorohydrin creping adhesives. The creping release aid disclosed herein is a plasticizer for the polyamine/epihalohydrin (PAE) resin and has a swelling ratio of at least 0.10 and a solubility parameter greater than 20 $MPa^{1/2}$. This release aid is said to be compatible with and soluble in the PAE type of creping adhesive. Suitable release aids include aliphatic polyols or oligomers thereof having a number average molecular weight of less than 600, polyalkanolamines, aromatic sulfonamides, pyrrolidone, and mixtures thereof. Ethylene glycol is most preferred. Other release aids are propylene glycol, diethylene glycol, glycerol, triethylene glycol, dipropylene glycol, polyalkanolamines, aromatic sulfonamides, pyrrolidone, and mixtures thereof.

There is a need in the industry for an improved creping release aid that is compatible with all types of creping adhesive aids, including the PAE type of adhesive, and that provides a high level of absorbency compared to typical present day oil-based release components while still providing a high degree of lubrication between the paper web and the doctor blade in the creping process.

SUMMARY OF THE INVENTION

The invention provides an improved creping release aid comprised of a non-oil-based chemical compound. Preferably, this non-oil-based chemical compound used as a release aid in a creping process is represented by the following formula for its block version:

$$R—(OC_3H_6)_y(OC_2H_4)_zOH;$$

where R is a $C_8$ to $C_{20}$ alkyl or alkylaryl group, y plus z is greater than 20, and y is greater than z. The y moles of propylene oxide ($OC_3H_6$) and the z moles of ethylene oxide ($OC_2H_4$) may be added in random or block fashion. As indicated, the block version is depicted in the above formula. The non-oil-based chemical compound generally may be selected from the group consisting of alkoxylated alkylphenols, alkoxylated fatty acids, and alkoxylated alcohols.

In a preferred embodiment, the non-oil-based chemical compound of the invention used as a release aid is an alkoxylated tall oil fatty acid where R is consistent with the alkyl chains of tall oil fatty acid, y is greater than 40, and z is less than 8, with the propylene oxide and the ethylene oxide added in block fashion as represented in the above formula. A further preferred embodiment is when the propylene oxide and the ethylene oxide are added in random fashion.

The release aid of the invention may be used with one or more surfactants in order to help emulsify the major component in the aqueous solution for spraying onto the Yankee dryer. These emulsifiers may include but are not limited to fatty acids, PEG (polyethylene glycol) esters, alkoxylated alcohols, alkoxylated fatty acids, and/or alkoxylated alkylphenols.

The release aid may comprise from about 0% to about 10% water by weight, about 0% to about 20% of one or more emulsifying surfactants by weight, and about 70% to about 100% by weight of the release aid of the above described chemical compound. More preferably, the release aid may comprise 0% water by weight, about 2% to about 10% by weight of one or more emulsifying surfactants, and about 90% to about 98% by weight of the release aid of the above described chemical compound.

If the release aid of the invention is in aqueous form then the aqueous solution comprises from about 90.0% to about 99.99% by weight water and from about 10.0% to about 0.01% solids by weight which comprises the release aid.

The release aid may also be used in combination with a creping adhesive aid that may be of any type that is known to the industry.

The invention further provides a process for creping tissue paper in the manufacture of a paper product, comprising:

a) applying to a rotating creping cylinder an aqueous solution comprising from about 90.0% to about 99.99% water by weight and from about 10.0% to about 0.01% solids by weight comprised of a release aid;

b) pressing a paper web against the creping cylinder to effect adhesion and thereafter release of the web from the surface of the cylinder; and c) dislodging the web from the creping cylinder with a doctor blade, wherein said release aid in step (a) is comprised of a non-oil based chemical compound represented by the following formula for its block version:

$$R—(OC_3H_6)_y(OC_2H_4)_zOH;$$

where R is a $C_8$ to $C_{20}$ alkyl or alkylaryl group, y plus z is greater than 20, y is greater than z, and wherein the y moles of propylene oxide($OC_3H_6$) and the z moles of ethylene oxide ($OC_2H_4$) may be added in random or block fashion.

Examples of the non-oil-based chemical compound used in the invention are alkoxylated alkylphenols, alkoxylated fatty acids, and alkoxylated alcohols.

The tissue web can be comprised of various types of natural fibers including wood pulps of chemical and mechanical types. The tissue web can also be comprised of particulate fillers, such as kaolin clay, titanium dioxide, and/or calcium carbonate.

It is therefore, an objective of the present invention to provide a release aid in a creping process for the manufacture of a tissue/towel product that is compatible with all types of creping adhesives, that provides lubrication between the paper web and the doctor blade and that allows the amount of adhesion between the paper web and the Yankee dryer to be moderated.

It is still a further objective of the present invention to provide a non-oil-based release aid for a creping process in the manufacture of a tissue/towel product that produces a positive effect on absorbency when compared to typical oil-based release aids.

These and other objectives of the present invention will be better appreciated and understood by those skilled in the art from the following description of the drawings and the claims.

BRIEF DESCRIPTION OF THE DRAWINGS

FIG. 1 is a graph showing the peel force of some release aids with a PAE-type coating adhesive.

FIG. 2 is a graph showing the impact of some release aids and wetting agents on the initial or uncured absorbency of hardwood sulfite pulp.

FIG. 3 is a graph showing the impact of some release aids and wetting agents on the aged or cured absorbency of hardwood sulfite pulp.

DETAILED DESCRIPTION OF THE INVENTION

As used herein, the terms "tissue paper web, paper web, web, paper sheet, and paper product" all refer to sheets of paper made by a process comprising the steps of forming an aqueous papermaking furnish; depositing this furnish onto a foraminous surface, such as a Fourdrinier wire, and removing the water from the furnish either by gravity or by vacuum assisted drainage. The final steps of the tissue/towel making process involve adhering the sheet in a semi-dry condition onto the surface of a Yankee dryer, completing the water removal by evaporation to an essentially dry state, and removing the web from the Yankee dryer by means of a flexible doctor blade and placing the web onto a reel. An example of a paper machine and a papermaking process that may be used in conjunction with the teachings of the invention are disclosed in U.S. Pat. No. 5,944,954, the general principles of which are incorporated herein by reference. However, it is to be understood that the release aid of the invention can be used in other known papermaking processes and in other known paper machines for manufacturing tissue and/or towel paper products.

All percentages, ratios and proportions herein are by weight unless otherwise specified.

In its most general form, the invention is a release aid comprising a non-oil-based chemical compound that is used in a creping process for the manufacture of tissue or towel products. The release aid is generally sprayed onto the Yankee dryer in aqueous form along with an adhesive that is also in aqueous form prior to the point where the wet paper web contacts the dryer. The release aid provides lubrication between the Yankee dryer surface and the doctor blade used to crepe the tissue paper from the Yankee dryer. The release aid also allows the tissue paper to release from the adhesive during the creping process.

The release aid of the invention is a non-oil-based chemical compound represented by the following formula for its block version:

$$R—(OC_3H_6)_y(OC_2H_4)_zOH;$$

where R is a $C_8$ to $C_{20}$ alkyl or alkylaryl group, y plus z is greater than 20, and y is greater than z. The y moles of propylene oxide ($OC_3H_6$) and the z moles of ethylene oxide ($OC_2H_4$) may be added in random or block fashion.

Random addition of propylene oxide and ethylene oxide involves both components being added to the hydrophobe (—R) simultaneously where their addition to the molecule is controlled by their relative amounts and reaction rates. Thus, the resultant reaction is somewhat unpredictable and can not be represented by a single formula. However, block addition is represented by the formula disclosed herein above. This means that propylene oxide is added to the hydrophobe (—R) first and allowed to react. Then, the ethylene oxide is added and allowed to react.

Examples of the chemical compound of the release aid of the invention represented by the above formula are alkoxylated alkylphenols, alkoxylated fatty acids, and alkoxylated alcohols.

Preferably, for the release aid of the invention, R is consistent with the alkyl chains of tall oil fatty acid, y>40, and z<8, and the y moles of the propylene oxide and the z moles of the ethylene oxide are added in block fashion as shown in the formula above. More preferably, y=87 and z=4.

The release aid of the invention may comprise from about 0% to about 10% water by weight, about 0% to about 20% by weight of one or more emulsifying surfactants, and about 70% to about 100% by weight of the chemical compound discussed herein above. More preferably, the release aid may comprise 0% water by weight, about 2% to about 10% by weight of one or more emulsifying surfactants, and about 90% to about 98% of the chemical compound discussed herein above. The optional surfactants are used to emulsify the chemical compound in water to form a stable dispersion and may include but are not limited to fatty acids, polyethylene glycol esters, alkoxylated alcohols, alkoxylated fatty acids, and alkoxylated alkylphenols. If the release aid is used in an aqueous solution which can be applied to the Yankee cylinder, e.g. by spraying, then the aqueous solution may comprise from about 90.00% to about 99.99% by weight water and from about 10.00% to about 0.01% by weight of the release aid of the invention.

The total amount of release aid described herein above applied to the creping cylinder is preferably from about 0.1 lb/ton to about 10 lb/ton. The unit lb/ton, as used herein, refers to the dry amount of release aid measured in pounds relating to the dry amount of paper produced in tons.

The release aid of the invention can be used with a well-known creping adhesive. An example of a suitable creping adhesive is a water-soluble, cationic polyamide-epihalohydrin (PAE) resin. This PAE resin comprises the reaction product of an epihalohydrin and a long chain polyamide containing at least two primary amine groups and at least one secondary amine group.

A polyamide-epihalohydrin resin that can be used as a creping adhesive aid in conjunction with the release aid of the invention can be obtained commercially from several companies. Examples are Kymene® and Crepetrol®, which are trademarks of and available from Hercules, Inc. of Wilmington, Del.; Unisoft® and Rezosol®, which are trademarks of and available from Houghton International, Inc. of Valley Forge, Pa.; and Callaway® 5821, which is a trademark of and available from Callaway Corporation.

These PAE resins are generally supplied as a concentrated solution in water, and are diluted for spraying onto the cylinder of a Yankee dryer or onto a semi-dry tissue web.

The basic chemistry in the preparation of this water-soluble cationic polyamide-epihalohydrin (PAE) resin (I) is described in several patents. These patents are U.S. Pat. No. 2,926,116 issued to Keim on Feb. 23, 1960; U.S. Pat. No. 2,926,154 issued to Keim on Feb. 23, 1960; U.S. Pat. No. 3,058,873 issued to Keim, et al. on Oct. 16, 1962; and U.S. Pat. No. 3,772,076 issued to Keim on Nov. 13, 1973, all of which are incorporated by reference in their entirety. These PAE resins may be used as wet-strength resins, i.e. resins added to the paper slurry at the wet end of the paper machine to impart a desired degree of strength to the manufactured paper when wet, but can also be used as a creping adhesive which is sprayed onto the cylinder of a Yankee dryer prior to the point where the paper web contacts the dryer.

An additional example of a creping adhesive which may be used in conjunction with the release aid of the invention is a polyalkylene polyamine/epihalohydrin resin described for example in U.S. Pat. Nos. 2,595,935; 3,248,353 and 3,655,506, the disclosures of which are incorporated by reference in their entirety. These PAE resins are made from a polyalkylene polyamine having at least one secondary amine group and a saturated aliphatic dicarboxylic acid or dicarboxylic acid derivative. Preparation of polyamidoamine/epihalohydrin resins is described, for example, in the aforesaid U.S. Pat. No. 5,338,807 and Canada 979,579, the disclosures of which are incorporated by reference in their entirety. These polyamine/epihalohydrin resins are typically water-soluble and crosslinkable.

As stated herein above, the present day release aids are petroleum-based oils with optional emulsifiers that help to keep the oils suspended in water for spraying onto the Yankee cylinder. Oil in contact with the tissue often causes a reduction in the absorbency of the tissue due to the hydrophobic nature of the oil. The inventors hypothesize that since the release aid of the invention does not contain oil, the spraying of the release aid onto the Yankee cylinder will not alter the effective absorbency inherent in the paper pulp. Matter of fact, it has been shown that the release aid of the invention has improved the absorbency of the tissue when added to the paper pulp used to manufacture the tissue. These results are shown and described in the Examples below. Needless to say, absorbency is critical to the function of many grades of tissue and towel paper products.

The wet tack adhesion of several release aid blends, including the release aid of the invention, used with a creping adhesive was measured using a peel test procedure. In the peel test procedure, a cloth strip was attached to a metal plate that was coated with the creping adhesive/release aid blend and then peeled at a 180° angle. The cloth strip used in the test was a 20"×2" cotton bed sheet having a 230-thread count. The metal plate to which the cloth was adhered was a 10"×4"×¾ low carbon steel block. This plate had a 10"×4" silicone rubber heating mat that was glued to its back. This heating mat was powered using a PID temperature controller. A J-type thermocouple, inserted through a 3/16" hole that was bored into the center of the plate, was used to provide a control signal.

In the peel test procedure, a creping adhesive/release aid blend film (10–15% solids) was uniformly applied to the test plate by a #40 coating rod. In order to cure the adhesive film the plate was heated to 100° C. and then maintained at this temperature for 10 minutes. The cloth strip was saturated with deionized water and then was blotted using a cotton blotting paper. The cloth strip was then carefully applied to the cured adhesive film by rolling the cloth strip with a two kilogram cylinder until uniform contact was achieved between the cloth and the cured adhesive film. The plate was then placed into a 120° C. oven for 15 minutes to allow the water to evaporate from the cloth strip. After the plate was removed from the oven, the plate with the attached cloth strip was mounted on an Instron® tensile tester. The cloth strip was then peeled off the plate at a 180° angle at a constant rate of 20 cm/min while the temperature of the plate was maintained at 100° C. The average force (in grams/inch) needed to peel the cloth from the plate was recorded as the wet tack adhesion.

The ability of the non-oil-based release aid of the invention, an oil-based release aid, and several wetting agents to change the absorbency of a tissue or towel product was measured using an absorbency test procedure. In the absorbency test procedure, a 0.1% solids aqueous release aid dispersion was added to 500 g of 0.5% solids pulp at 40° C. and mixed for five minutes. A 60 g/m$^2$ handsheet was prepared from the pulp using a Noble & Wood handsheet mold. The sheet was pressed and dried in a steam-heated rotary drum dryer.

The sheet was cut in half, and half was put through an accelerated aging process by heating it to 150° C. for eight minutes in a waffle iron modified with two flat stainless steel plates. This curing process was done to simulate the loss of absorbency caused by storing the paper for several weeks or months on store shelves. During this period, resinous materials from the paper can migrate and rearrange on the fiber surface to cause the paper to become highly resistant to water absorption (Swanson and Cordingly, "Surface Chemical Studies on Pitch", TAPPI J. 42 No. 10:812–819). The cured and uncured halves of the sheet were allowed to equilibrate overnight.

The absorbency of the cured and the uncured handsheets was measured using a water drop test. The absorbency time was determined as the time in seconds for a 10 $\mu$l drop of distilled water to completely absorb into the handsheet. Thus, sheets with shorter absorbency times are considered more absorbent. A total of five such drop tests were conducted on each handsheet and the average was recorded.

EXAMPLES

The following examples illustrate the use of the release aid of the invention. These examples are intended to aid in understanding the present invention, however, in no way, should these examples be interpreted as limiting the scope thereof.

Example 1

The ability of some release aids, including the release aid of the invention, to reduce the wet tack adhesion of a polyamidoamine-epichlorohydrin (PAE) adhesive was measured using the peel test described herein above. The PAE adhesive used in this Example is available from Calgon Corporation under the trade name crepECCel™. The peel test was used to simulate the amount of force necessary to peel the paper web from the Yankee dryer. The release aids tested were:

- releasECCel™ 640D: about 83% oil-based release aid with about 17% surfactants as emulsifiers available from Calgon Corporation.
- Composition A: a release aid of the invention consisting of 83% alkoxylated tall oil fatty acid and 17% surfactants as emulsifiers. The alkoxylated tall oil fatty acid has R groups consistent with the alkyl chains of tall oil fatty acid, y=87, z=4, and the y moles of the propylene oxide and the z moles of the ethylene oxide are added in block fashion.
- Solvox 5325: an oil-based release aid available from Solvox Corporation.

The results of the peel force testing are plotted in FIG. 1. The peel force for the adhesive/release aid blend is expressed as a percentage of the peel force of the adhesive alone. The amount of release is expressed as a percentage of the overall solids in the adhesive/release aid blend. FIG. 1 shows that the release aid of the invention (Composition A) exhibited the same ability to reduce the adhesion of crepECCel™ 690HA, a typical PAE-type adhesive, as both releasECCel™ 640D and Solvox 5325, which are typical oil-based release aids presently being used in the creping process.

Example 2

The absorbency of bleached hardwood sulfite pulp treated with 2 lb/ton and 5 lb/ton of some release aids and wetting agents was measured using the absorbency test procedure described herein above. This test procedure was used to evaluate the impact of these chemicals on absorbency when added to the wet end of the paper machine where the stock consistency is low. However, it is reasonable to assume that a similar effect on absorbency would result when the paper web at 35% to 45% solids is pressed onto the cylinder of the Yankee dryer which is coated with 0.1 lb/ton to 10 lb/ton of release aid and a creping adhesive. In fact, the impact of the chemical added in this manner might be greater than when added at the wet end of the paper machine due to the physical contact between the chemical and the paper web. In that water is lost by evaporation and not filtration, there is no opportunity for the chemical to be washed from the paper web.

The products used in this Example 2 were:

- Release Aid (I): an alkoxylated tall oil fatty acid of the invention which has R groups consistent with the alkyl chains of tall oil fatty acid, y=87, z=4, and the propylene oxide and ethylene oxide groups are added in block fashion.
- releasECCel™ 640D: about 83% oil-based release aid with about 17% surfactants as emulsifiers available from Calgon Corporation.
- Propylene Glycol: a release aid that acts as a plasticizer for PAE creping adhesives according to U.S. Pat. No. 5,660,687 discussed herein above for modifying the properties of a coating to make it softer and more receptive to water.
- PEG-400: polyethylene glycol with a molecular weight of 400 and available from Union Carbide; described in U.S. Pat. No. 5,246,545 issued to Ampulski et al. as a wetting agent to improve the absorbency of a tissue or towel product.
- Brij-93: polyoxyethylene (2) oleyl ether available from ICI Americas, Inc.; described in U.S. Pat. No. 4,441,962 issued to Osborn III as a nonionic surfactant used to improve the absorbency of a tissue or towel product.

The impact of these release aids and wetting agents on the initial or uncured absorbency of the hardwood sulfite pulp is shown in FIG. 2. The absorbency time (seconds) is plotted against the dose of each chemical (pounds/ton). Each data point on the graph is an average from tests on three handsheets. Shorter absorbency times indicate improved absorbency. As can be seen in FIG. 2, the release aid (Release Aid (I)) of the invention improved the initial absorbency of the pulp to a greater extent than the other release aids or wetting agents.

The impact of the release aids and wetting agents described herein above in this Example 2 on the aged or cured absorbency of the hardwood sulfite pulp is shown in FIG. 3. The absorbency time (seconds) is plotted against the dose of each chemical (pounds/ton). Again, each data point on the graph is an average from tests on three handsheets. Shorter absorbency times indicate improved absorbency. As can be seen in FIG. 3, the release aid of the invention (Release Aid (I)) when used at 5 lb/ton improved the cured absorbency by 84% over the control with no treatment. There was about a 60% improvement when only 2 lb/ton of the release aid of the invention was used compared to the control with no treatment. None of the other release aids and wetting agents changed the cured absorbency significantly.

FIGS. 2 and 3 show that curing caused the absorbency time to increase from 10 seconds to 490 seconds when no chemical treatment was used. The use of 5 lb/ton of Release Aid (I) of the invention reduced this increase to only 76 seconds. This represents a dramatic improvement in the aged product.

EXAMPLE 3

Composition A, a release aid of the invention, was evaluated in combination with crepECCel™ 675P, a typical PAE-type adhesive, on a light dry crepe tissue machine producing a 10 lb per 3,000 $ft^2$ single ply for a two-ply bathroom tissue. The Yankee dryer speed was 4,100 ft/min. The performance of Composition A was compared to that of a typical oil-based release aid, releasECCel™ 640D. A detailed description of the chemicals (some of which were used in previous examples) used in this example follows:

Composition A: a release aid of the invention consisting of 83% alkoxylated tall oil fatty acid and 17% surfactants as emulsifiers. The alkoxylated tall oil fatty acid has R groups consistent with the alkyl chains of tall oil fatty acid, y=87, z=4, and the y moles of the propylene oxide and the z moles of the ethylene oxide are added in block fashion.

releasECCell™ 640D: about 83% oil-based release aid with about 17% surfactants as emulsifiers available from Calgon Corporation.

crepECCel™ 675P: an aqueous solution consisting of about 14% of a typical PAE adhesive with about 4% of diammonium phosphate available from Calgon Corporation.

The optimal dosage rates were determined to be 0.3 lb/ton of crepECCel™ 675P and 0.4 lb/ton of Composition A. The use of Composition A with crepECCel™ 675P allowed the coating to develop more uniformly deckle to deckle and reduced doctor blade wear significantly compared to the use of releasECCel™ 640D with crepECCel™ 675P. Composition A was more effective at modifying the adhesive properties of the coating package. It took approximately ⅓ the dosage of Composition A to get the same blade wear and operating performance as releasECCel™ 640D.

Examples 1 to 3 show the advantage of using the release aid of the invention. Example 1 presents some evidence that the release aid of the invention provides an equivalent ability to reduce the adhesion of PAE creping adhesives when compared to commercially available oil-based release aids. Example 2 presents some evidence that the invention improves the initial and aged absorbency of the paper significantly beyond that achievable with current release aids and wetting agents. Example 3 gives evidence that the invention is able to function exceptionally as a release aid on a commercial tissue machine, i.e. it allowed the formation of a uniform coating on the Yankee dryer and provided excellent lubrication between the doctor blade and the coating.

While the present invention has been particularly set forth in terms of specific embodiments thereof, it will be understood in view of the instant disclosure that numerous variations upon the invention are now enabled yet reside within the scope of the invention. Accordingly, the invention is to be broadly construed and limited only by the scope and spirit of the claims now appended hereto.

What is claimed is:

1. A method of creping paper webs comprising:

a) applying to a rotating creping cylinder a creping adhesive and a creping release aid;

b) pressing the paper web against the creping cylinder to effect adhesion of the web to the surface of the cylinder; and c) dislodging the paper web from the creping cylinder with a doctor blade to form a paper product, wherein the creping release aid comprises 0 to about 10% by weight water, 0 to about 20% by weight of one or more emulsifying surfactants and from about 70 to about 100% by weight of a non-oil-based chemical compound selected from the group consisting of alkoxylated alkylphenols, alkoxylated fatty acids and alkoxylated alcohols, wherein the alkoxylated alkylphenol, alkoxylated fatty acid or alkoxylated alcohol is prepared by reacting a $C_8$ to $C_{20}$ alkylphenol, fatty acid or alcohol with y molar equivalents of propylene oxide and z molar equivalents of ethylene oxide, wherein y plus z is greater than about 20, and y is greater than z, and wherein the y moles of propylene oxide and the z moles of ethylene oxide are added in random or block fashion.

2. The method of claim 1 wherein the fatty acid is tall oil fatty acid, y is greater than about 40 and z is less than about 8.

3. The method of claim 2 wherein the propylene oxide and ethylene oxide are added in random fashion.

4. The method of claim 2 wherein the propylene oxide and ethylene oxide are added in block fashion, the propylene oxide being added first.

5. The method of claim 4 wherein y is about 87 and z is about 4.

6. The method of claim 1 wherein the emulsifying surfactants are selected from the group consisting of fatty acids, polyethylene glycol esters, alkoxylated fatty acids, alkoxylated alcohols and alkoxylated alkylphenols.

7. The method of claim 1 wherein the creping release aid is mixed with water to form an aqueous dispersion containing from about 0.01 to about 10 percent by weight of the creping release aid prior to applying to the rotating creping cylinder.

8. The method of claim 7 wherein the aqueous solution is applied by spraying onto the rotating creping cylinder.

9. The method of claim 1 wherein from about 0.1 pounds/ton to about 10 pounds/ton, based on the dry weight of the release aid and the dry weight of the paper product, of release aid is applied to the creping cylinder.

* * * * *